US008720599B2

(12) United States Patent
Ikuta

(10) Patent No.: US 8,720,599 B2
(45) Date of Patent: May 13, 2014

(54) POWER TOOL WITH ROTATABLE TOOL HOLDER

(75) Inventor: Hiroki Ikuta, Anjo (JP)

(73) Assignee: Makita Corporation, Anjo (JP)

( * ) Notice: Subject to any disclaimer, the term of this patent is extended or adjusted under 35 U.S.C. 154(b) by 419 days.

(21) Appl. No.: 12/934,149

(22) PCT Filed: Mar. 26, 2009

(86) PCT No.: PCT/JP2009/056163
§ 371 (c)(1),
(2), (4) Date: Dec. 2, 2010

(87) PCT Pub. No.: WO2009/119760
PCT Pub. Date: Oct. 1, 2009

(65) Prior Publication Data

US 2011/0073338 A1 Mar. 31, 2011

(30) Foreign Application Priority Data

Mar. 27, 2008 (JP) ..... 2008-085010

(51) Int. Cl.
*B25D 17/00* (2006.01)
*B25D 17/11* (2006.01)
*B25D 17/24* (2006.01)
*E21B 3/00* (2006.01)

(52) U.S. Cl.
USPC ..... 173/162.1; 173/164

(58) Field of Classification Search
CPC ..... B25B 1/02; B25B 23/0035; B25C 1/06; B25D 11/02
USPC ..... 173/162.1, 39, 90, 141, 213
See application file for complete search history.

(56) References Cited

U.S. PATENT DOCUMENTS 4,065,941 A * 1/1978 Aoki ..... 464/115
4,111,442 A * 9/1978 Wawrzyniak ..... 279/16

(Continued)

FOREIGN PATENT DOCUMENTS

EP 0 440 399 A1 8/1991
JP A-58-34271 2/1983

(Continued)

OTHER PUBLICATIONS

Oct. 22, 2012 Extended European Search Report issued in European Application No. 09724230.9.

(Continued)

*Primary Examiner* — Robert Long
(74) *Attorney, Agent, or Firm* — Oliff PLC

(57) ABSTRACT

It is an object of the invention to reduce transmission of an external force caused by run-out of a tool bit to a tool body in a power tool is provided. A representative power tool which performs a predetermined operation by linear motion of a tool bit in its axial direction has a tool body, a tool holder that holds the tool bit in its front end region and extends in the axial direction of the tool bit, and an elastic element. A rear region of the tool holder opposite from the front end region extends into the tool body, and in the extending region, the tool holder is coupled to the tool body such that the tool holder can rotate about a pivot on a z-axis defined by an axis of the tool bit, in directions of y- and x-axes which intersect with the z-axis. The elastic element applies a biasing force to the tool holder in such a manner as to hold the tool holder in a predetermined position or an initial position with respect to the tool body.

13 Claims, 9 Drawing Sheets

(56) References Cited

U.S. PATENT DOCUMENTS

| | | | | | |
|---|---|---|---|---|---|
| 4,188,801 | A * | 2/1980 | Hugh et al. | 464/106 |
| 4,269,421 | A * | 5/1981 | Wawrzyniak | 279/16 |
| 4,347,450 | A * | 8/1982 | Colligan | 310/50 |
| 4,936,701 | A * | 6/1990 | Allen et al. | 403/57 |
| 5,205,457 | A * | 4/1993 | Blomquist, Jr. | 227/66 |
| 5,515,754 | A * | 5/1996 | Elkins | 81/177.9 |
| 5,738,586 | A * | 4/1998 | Arriaga | 464/106 |
| 5,784,934 | A * | 7/1998 | Izumisawa | 81/57.26 |
| 5,797,536 | A * | 8/1998 | Smith et al. | 227/175.1 |
| 6,039,129 | A * | 3/2000 | McLeod | 175/258 |
| 6,099,210 | A * | 8/2000 | Grainger | 407/76 |
| 6,386,075 | B1 * | 5/2002 | Shiao | 81/177.8 |
| 6,651,990 | B2 * | 11/2003 | Higasi et al. | 279/19.4 |
| 6,775,013 | B2 * | 8/2004 | Wang | 356/614 |
| 7,178,487 | B2 * | 2/2007 | Zahner et al. | 123/46 H |
| 7,191,677 | B2 * | 3/2007 | Barkdoll | 74/396 |
| 7,591,839 | B2 * | 9/2009 | Biedermann et al. | 606/266 |
| 7,614,460 | B2 * | 11/2009 | Henriksson et al. | 173/109 |
| 7,726,919 | B1 * | 6/2010 | Rottler et al. | 409/234 |
| 8,192,103 | B2 * | 6/2012 | Tsai | 403/72 |
| 2005/0098584 | A1 * | 5/2005 | Do Rosario | 222/321.7 |
| 2008/0168868 | A1 * | 7/2008 | Yang | 81/177.75 |

FOREIGN PATENT DOCUMENTS

| | | | | |
|---|---|---|---|---|
| JP | 06079652 | A * | 3/1994 | B25D 17/12 |
| JP | A-6-79652 | | 3/1994 | |
| JP | A-2005-335046 | | 12/2005 | |
| RU | 2 288 835 | C2 | 6/2006 | |
| WO | WO 2006/004547 | A1 | 1/2006 | |
| WO | WO 2006004547 | A1 * | 1/2006 | B25D 17/24 |

OTHER PUBLICATIONS

Nov. 18, 2010 International Preliminary Report on Patentability issued in International Patent Application No. PCT/JP2009/056163 (with translation).

International Search Report dated Jun. 30, 2009 in corresponding International Application No. PCT/JP2009/056163 (with translation).

Russian Office Action dated Sep. 10, 2013 from Russian Patent Application No. 2010143873/02 (with English-language translation).

* cited by examiner

POWER TOOL WITH ROTATABLE TOOL HOLDER

FIELD OF THE INVENTION

The invention relates to a vibration-proofing technique in a power tool, such as a hammer and a hammer drill, which linearly drives a tool bit.

BACKGROUND OF THE INVENTION

In a power tool such as a hammer and a hammer drill, during hammering operation or hammer drill operation by a hammer bit, the hammer bit is acted upon by a reaction (hereinafter referred to as a reaction force) from a workpiece. At this time, the hammer bit is caused to move by the reaction force not only in an axial direction of the hammer bit (fore-and-aft direction), but also in vertical and lateral directions transverse to the axial direction, and this motion is transmitted to a tool body via a tool holder which holds the hammer bit. Generally, in a power tool in which vibration is caused during operation, a mechanism for reducing transmission of vibration to the user is devised. For example, transmission of vibration caused in the tool body to the handgrip is reduced or prevented by connecting a handgrip to be held by a user to the tool body via an elastic element. One example is disclosed in Japanese Patent Publication No. 58-34271.

However, the above-described known vibration-proofing mechanism is constructed to prevent transmission of vibration to the handgrip to be held by a user. Therefore, it is difficult to prevent an external force which is caused by irregular motion or run-out of the hammer bit when the hammer bit is acted upon by a reaction force from a workpiece, from being transmitted to the tool body.

SUMMARY OF THE INVENTION

Accordingly, it is an object of the invention to reduce transmission of an external force caused by irregular motion of a tool bit to a tool body of a power tool.

Above-described object can be achieved by a claimed invention. According to the invention, a representative power tool performs a predetermined operation by linear motion of a tool bit in its axial direction. The power tool has a tool body, a tool holder that holds the tool bit in its front end region and extends in the axial direction of the tool bit, and an elastic element. Further, the "operation" according to this invention may preferably includes not only a hammering operation but also a hammer drill operation. Further, the "tool body" according to the invention typically represents a cylindrical housing which forms part of an outer shell of the power tool or a barrel which extends in the axial direction of the tool bit and houses a striking mechanism which applies a striking force to the tool bit.

In the representative power tool according to the invention, a rear region of the tool holder opposite from its front end region extends into the tool body. In such a state that the rear region of the tool holder extends into the tool body, the tool holder is coupled to the tool body such that it can rotate about a pivot on a z-axis which is defined by an axis of the tool bit, in directions of y- and x-axes which intersect with the z-axis. The elastic element applies a biasing force to the tool holder in such a manner as to hold the tool holder in a predetermined rotational position or an initial position with respect to the tool body. The "pivot on a z-axis" according to the invention is a hypothetical pivot on the z-axis. Further, the manner in which the tool holder "rotates about a pivot" according to this invention represents the manner in which the tool holder rotates about a pivot on the axis of the tool bit in a horizontal direction and a vertical direction which intersect with the axial direction of the tool bit, for example, in a construction in which the axis of the hammer bit extends in the horizontal direction. The "elastic element" in this invention typically represents a coil spring, but suitably includes a rubber.

According to this invention, the tool holder for holding the tool bit can rotate with respect to the tool body about a pivot on the z-axis running along the axial direction of the tool bit, in the directions of the y- and x-axes which intersect with the z-axis, and the tool holder is held in its initial position by the elastic element. Therefore, during operation, when the tool bit causes irregular movement such as a run-out by a reaction force from the workpiece and such run-out is transmitted to the tool holder holding the tool bit as a motion in the direction of the y-axis or x-axis which intersects with the axial direction of the tool bit, the tool holder rotates about the pivot on the axis of the tool bit, Then the elastic element absorbs this rotation of the tool holder by elastic deformation. Thus, the external force which is caused by run-out of the tool bit acted upon by the reaction force from the workpiece during operation is not easily transmitted to the tool body, so that vibration of the tool body can be reduced.

According to a further aspect of the invention, the tool holder is coupled to the tool body via a spherical connection which is formed by a convex spherical surface centered on a pivot on the z-axis and a concave spherical surface which conforms to the convex spherical surface. With such a construction, the tool holder can smoothly rotate about the pivot on the z-axis, so that transmission of the external force caused by run-out of the tool bit to the tool body can be effectively reduced.

According to a further aspect of the invention, the tool bit is designed as a hammer bit which performs a hammering operation by applying a linear striking force to a workpiece. The power tool further includes a motor, a striking element that is linearly driven in the axial direction of the hammer bit by the motor, and an intermediate element that is housed within the tool holder such that it can slide in the axial direction of the hammer bit and serves to transmit linear motion of the striking element to the hammer bit. The intermediate element is coupled to the tool body such that it can rotate about the pivot on the z-axis. Further, a second elastic element is disposed between the tool body and the intermediate element and applies a biasing force to the intermediate element in such a manner as to hold the intermediate element in an initial position.

According to the invention, in the power tool in which the hammer bit performs a linear striking motion, the external force caused by run-out of the hammer bit is not easily transmitted to the tool body via the tool holder and the intermediate element, so that vibration of the tool body can be reduced. Further, when the hammer bit performs a striking movement on the workpiece, the hammer bit is acted upon by the axial reaction force from the workpiece and this reaction force is then exerted on the second elastic element via the intermediate element. Specifically, the second elastic element elastically deforms by the axial reaction force exerted from the intermediate element and absorbs the axial reaction force. Thus, vibration of the tool body can be reduced.

According to a further aspect of the invention, the tool holder and the intermediate element are coupled to the tool body via a second spherical connection which is formed by a convex spherical surface centered on a pivot on the z-axis and a concave spherical surface which conforms to the convex spherical surface. With such a construction, the tool holder and the intermediate element can smoothly rotate about the pivot, so that transmission of the external force caused by run-out of the tool bit to the tool body can be effectively reduced.

According to a further aspect of the invention, the tool body has a cylindrical tool holder receiving part that receives the extending region of the tool holder extending into the tool body. The power tool further includes a slide member that is disposed on the outside of the tool holder receiving part and can move in the axial direction of the tool bit, a plurality of ball holding holes that are formed in the tool holder receiving part at predetermined intervals in the circumferential direction and radially extend through the tool holder receiving part, and balls that are loosely fitted in the ball holding holes and disposed between the slide member and the tool holder. The elastic element is disposed between the tool body and the slide member, and the biasing force of the elastic element is transmitted from the slide member to the tool holder via the balls. With such a construction in which the biasing force of the elastic element is transmitted to the tool holder via the slide member which moves in the axial direction of the tool bit and the balls, the direction of elastic deformation of the elastic element can be limited to a direction parallel to the axial direction of the tool bit. Therefore, the tool body can be reduced in size in the radial direction.

In a further aspect of the invention, a sealing elastic element is disposed between the tool body and the tool holder and prevents leakage of lubricant sealed in an inner space of the tool body, and the biasing force of this elastic element is applied to the tool holder in such a manner as to hold the tool holder in the initial position. According to the invention, by providing the sealing elastic element with an additional function of returning the tool holder to the initial position, the sealing elastic element can be effectively utilized as a vibration absorbing member.

According to another aspect of the invention, a power tool is provided for performing a hammer drill operation in which a tool bit applies a linear striking force in an axial direction and a rotational force around its axis to a workpiece. The power tool has a tool body, a motor, a tool holder, an elastic element, a striking element and a cylindrical rotating member. The tool holder holds the tool bit in its front end region and extends in the axial direction of the tool bit. The striking element is linearly driven by the motor and causes the tool bit to perform linear striking motion. The cylindrical rotating member is mounted to the tool body such that it can rotate about the axis of the hammer bit and rotationally driven by the motor. Further, the "tool body" in this invention represents a cylindrical housing which forms part of an outer shell of the power tool, or a barrel which extends in the axial direction of the tool bit and houses a striking mechanism which applies a striking force to the tool bit.

In the power tool according to the invention, a rear region of the tool holder on the side opposite from the front end region extends into the cylindrical rotating member. In this extending region, the tool holder is coupled to the cylindrical rotating member such that it can rotate about a pivot on a z-axis defined by the axis of the tool bit, in directions of y- and x-axes which intersect with the z-axis, while rotating together with the cylindrical rotating member about the axis of the hammer bit. The elastic element applies a biasing force to the tool holder in such a manner as to hold the tool holder in a predetermined position or an initial position with respect to the tool body. Further, the manner in which the tool holder "rotates about a pivot" in this invention represents the manner in which the tool holder rotates about a pivot on the axis of the tool bit in a horizontal direction and a vertical direction which intersect with the axial direction of the tool bit, for example, in a construction in which the axis of the hammer bit extends in the horizontal direction. The "elastic element" in this invention typically represents a coil spring, but suitably includes a rubber.

According to this invention, in the hammer drill in which the hammer bit performs linear striking motion and circumferential rotation, the external force caused by run-out of the tool bit is not easily transmitted to the tool body via the tool holder, so that vibration of the tool body can be reduced.

According to a further aspect of the invention, the cylindrical rotating member has a cylindrical tool holder receiving part which receives the extending region of the tool holder extending into the cylindrical rotating member. The power tool further includes a slide member that is disposed on the outside of the tool holder receiving part and can move in the axial direction of the tool bit, a plurality of ball holding holes that are formed in the tool holder receiving part at predetermined intervals in a circumferential direction and radially extend through the tool holder receiving part, and balls that are loosely fitted in the ball holding holes and disposed between the slide member and the tool holder. The balls serve not only as a biasing force transmitting member which transmits the biasing force of the elastic element to the tool holder such that the tool holder is held in the initial position, but also as a torque transmitting member which transmits a rotational force of the cylindrical rotating member to the tool holder. With such a construction, a rational power transmitting structure can be provided.

According to the invention, transmission of an external force caused by an irregular motion such as a run-out of a tool bit to a tool body in a power tool can be reduced.

DETAILED DESCRIPTION OF THE INVENTION

First Embodiment of the Invention

Figure 1:
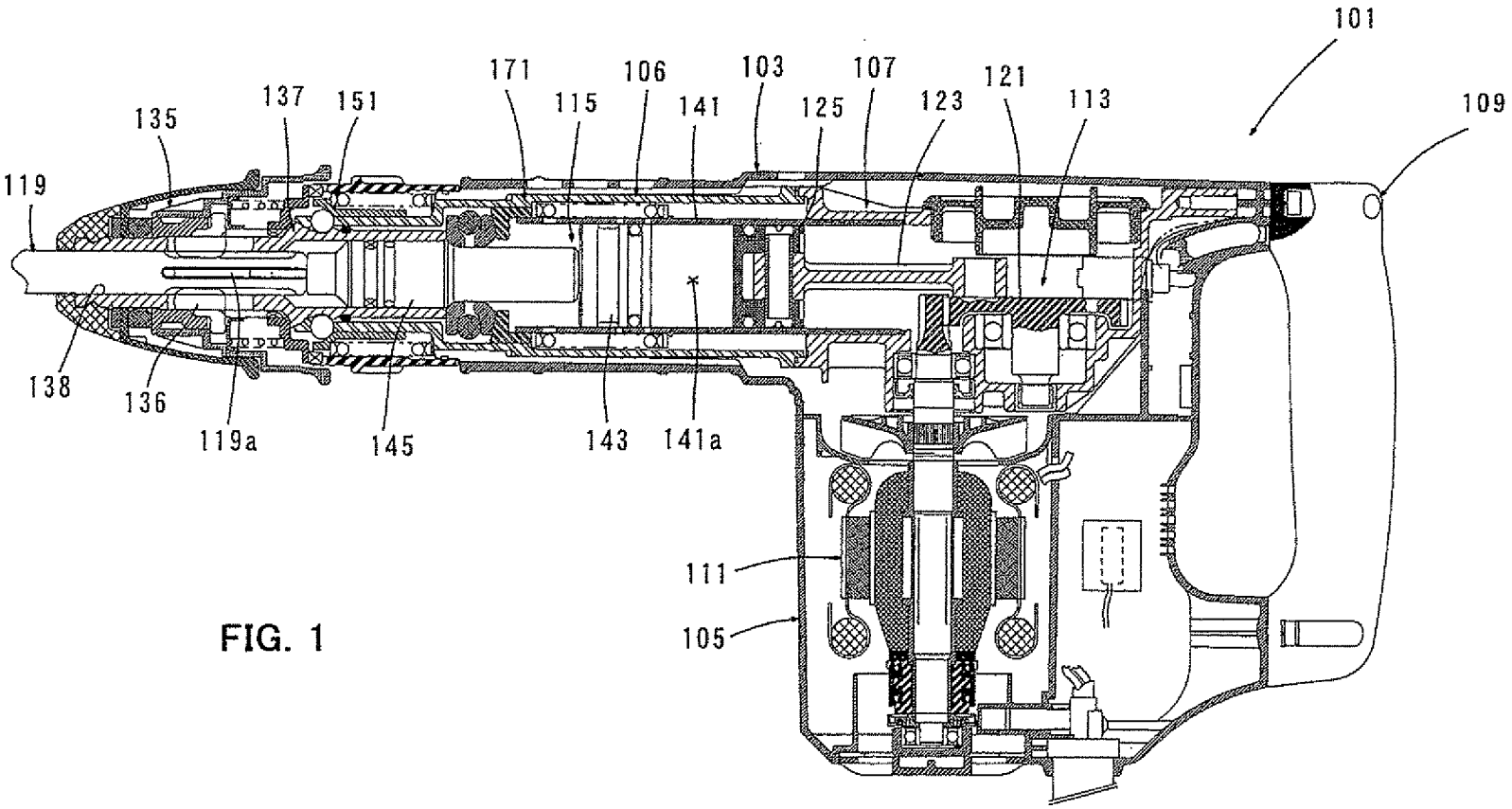
FIG. 1 is a sectional view showing an entire electric hammer according to a first embodiment of this invention.
Figure 2:
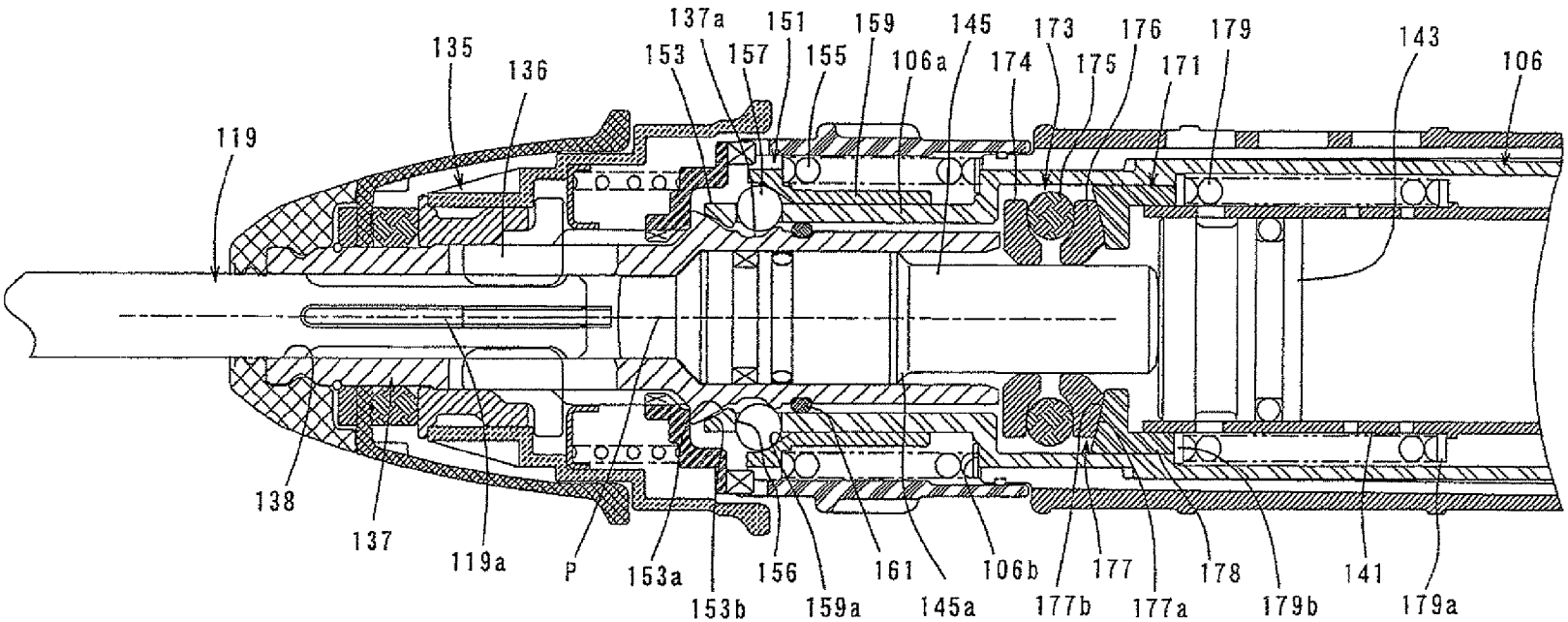
FIG. 2 is a sectional view showing an essential part of the electric hammer under unloaded conditions in which striking movement is not yet performed (and during idle striking immediately after completion of the striking movement).
Figure 3:
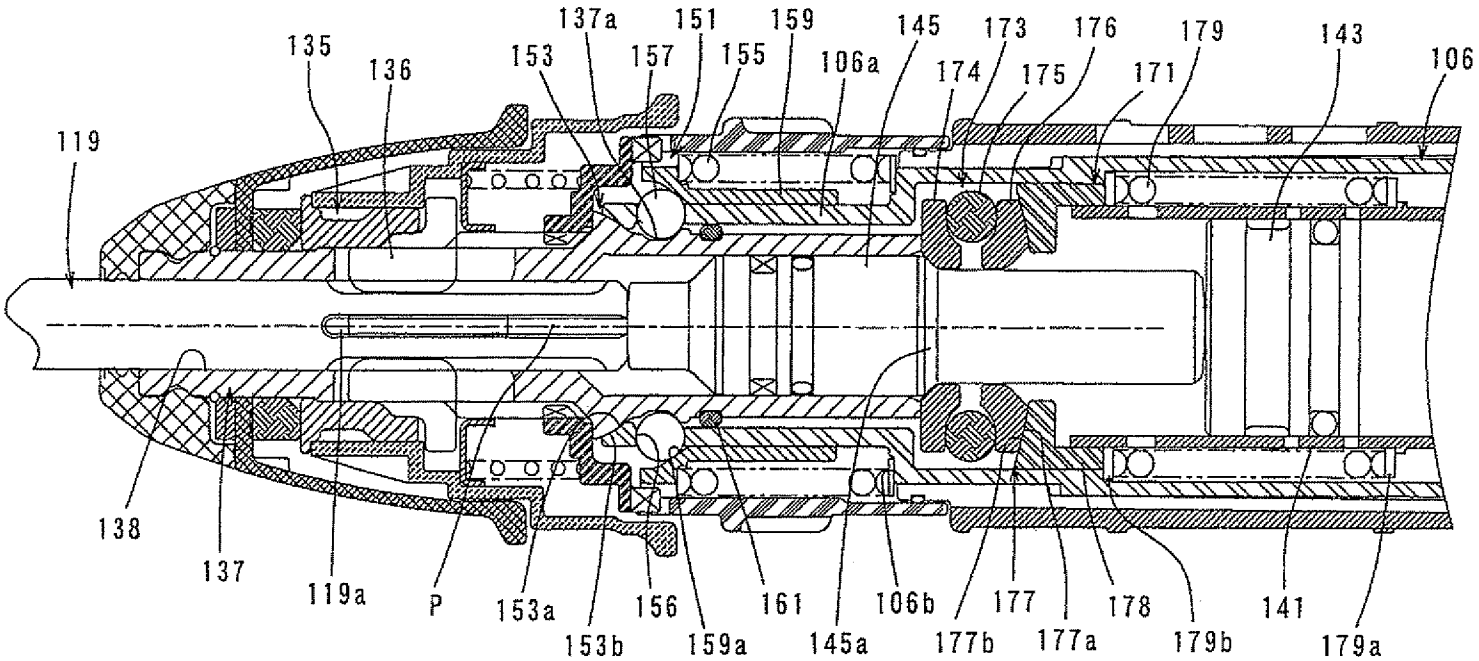
FIG. 3 is a sectional view showing the essential part of the electric hammer during striking movement.
Figure 4:
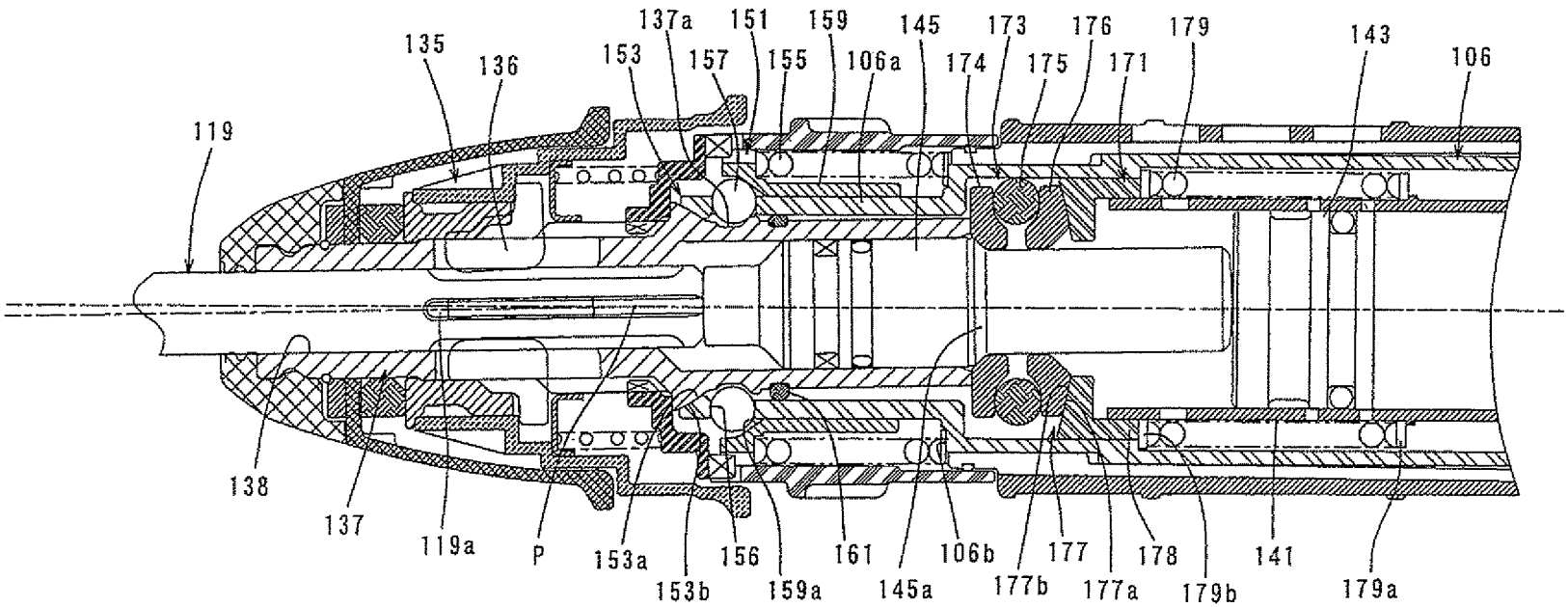
FIG. 4 is a sectional view showing the essential part of the electric hammer after completion of the striking movement.
Figure 5:
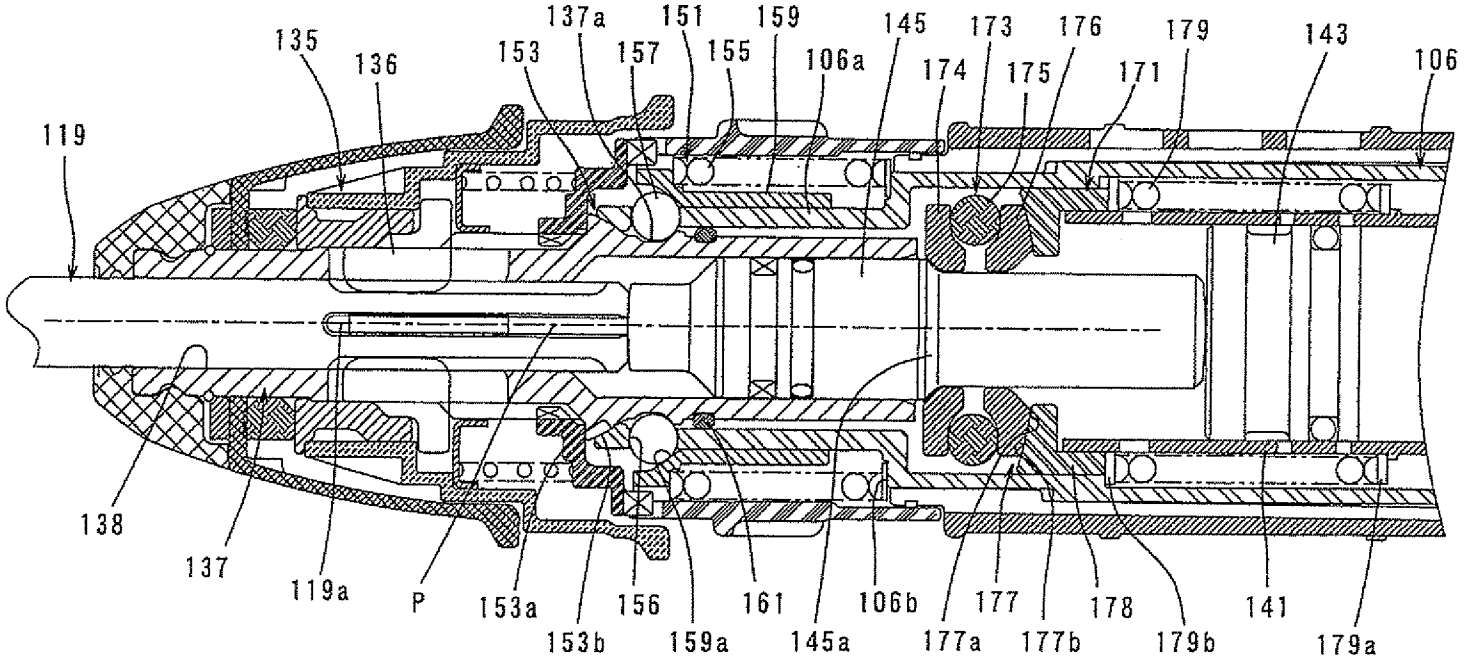
FIG. 5 is a sectional view showing the essential part of the electric hammer after completion of the striking movement.
Figure 6:
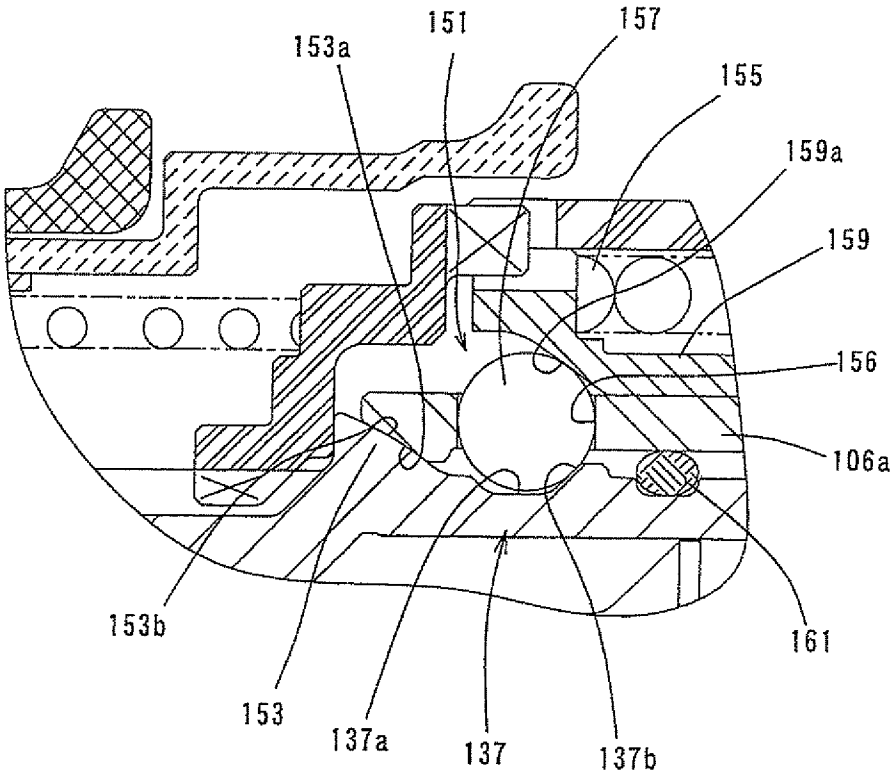
FIG. 6 is an enlarged view showing a first vibration-proofing mechanism.

A first embodiment of the invention is now described with reference to FIGS. 1 to 5. FIG. 1 is a sectional side view showing an entire electric hammer 101 as a representative example of a power tool according to the invention. FIGS. 2 to 4 are sectional views showing an essential part of the electric hammer 101. FIG. 2 shows the electric hammer 101 under unloaded conditions in which striking movement is not yet performed (and during idle striking immediately after completion of the striking movement) and FIG. 3 shows the electric hammer 101 during striking movement. FIGS. 4 and 5 show the electric hammer 101 after completion of the striking movement. Further, FIG. 6 is an enlarged view of a first vibration-proofing mechanism 151.

As shown in FIG. 1, the electric hammer 101 according to this embodiment mainly includes a body 103 that forms an outer shell of the electric hammer 101, a tool holder 137 coupled to a front end region (left end region as viewed in FIG. 1) of the body 103 in its longitudinal direction, a hammer bit 119 detachably coupled to the tool holder 137 and a handgrip 109 that is connected to the other end (right end as viewed in FIG. 1) of the body 103 in its longitudinal direction and designed to be held by a user. The body 103 and the hammer bit 119 are features that correspond to the "tool body" and the "tool bit", respectively, according to the invention. The hammer bit 119 is held by the tool holder 137 such that it is allowed to reciprocate in the axial direction of the hammer bit 119 (the longitudinal direction of the body 103) and prevented from rotating in its circumferential direction. For the sake of convenience of explanation, the side of the hammer bit 119 is taken as the front and the side of the handgrip 109 as the rear.

The body 103 mainly includes a motor housing 105 that houses a driving motor 111, and a gear housing 107 that houses a motion converting mechanism 113 and a barrel 106 that houses a striking mechanism 115. A cylindrical housing in the form of the barrel 106 is connected to the front end of the gear housing 107 and extends forward in the axial direction of the hammer bit 119. A rotating output of the driving motor 111 is appropriately converted to linear motion by the motion converting mechanism 113 and then transmitted to the striking mechanism 115. Then, an impact force is generated in the axial direction of the hammer bit 119 via the striking mechanism 115. The driving motor 111 is disposed such that an axis of its motor shaft extends in a direction transverse to an axis of the hammer bit 119. The motion converting mechanism 113 and the striking mechanism 115 form a driving mechanism of the hammer bit 119.

The motion converting mechanism 113 serves to convert rotation of the driving motor 111 into linear motion and transmit it to the striking mechanism 115. The motion converting mechanism 113 is formed by a crank mechanism including a crank shaft 121, a crank arm 123 and a driving element in the form of a piston 125. The crank shaft 121 is rotationally driven via a plurality of gears by the driving motor 111. The crank arm 123 is connected to the crank shaft 121 via an eccentric pin at a position displaced from the center of rotation of the crank shaft 121, and the piston 125 is reciprocated by the crank arm 123. The piston 125 serves to drive the striking mechanism 115 and can slide in the axial direction of the hammer bit 119 within a cylinder 141 disposed within the barrel 106.

The striking mechanism 115 mainly includes a striking element in the form of a striker 143 that is slidably disposed within the bore of the cylinder 141, and an intermediate element in the form of an impact bolt 145 that is slidably disposed in the tool holder 137 and serves to transmit kinetic energy of the striker 143 to the hammer bit 119. An air chamber 141 a is defined between the piston 125 and the impact bolt 143 within the cylinder 141. The striker 143 is driven via an air spring action of an air chamber 141*a* of the cylinder 141 which is caused by sliding movement of the piston 125. Then the striker 143 collides with (strikes) the impact bolt 145 slidably disposed within the tool holder 137 and transmits a striking force to the hammer bit 119 via the impact bolt 145.

In the electric hammer 101 thus constructed, when the driving motor 111 is driven under loaded conditions in which the hammer bit 119 is pressed against a workpiece by application of user's forward pressing force to the body 103, the piston 125 linearly slides along the cylinder 141 via the motion converting mechanism 113 which is mainly formed by the crank mechanism. When the piston 125 slides, the striker 143 moves forward within the cylinder 141 via the air spring action of the air chamber 141 a of the cylinder 141 and then collides with the impact bolt 145. The kinetic energy of the striker 143 which is caused by the collision is transmitted to the hammer bit 119. Thus, the hammer bit 119 performs a hammering operation on the workpiece (concrete).

The tool holder 137 is mounted to the barrel 106 such that it can rotate about the axis of the hammer bit with respect to the barrel 106. The hammer bit 119 is inserted into a bit holding hole 138 of the tool holder 137 from the front of the tool holder 137 and held by a bit holding device 135 fitted on a front portion of the tool holder 137. The bit holding device 135 has an engagement member in the form of a plurality of engagement claws 136 arranged in its circumferential direction and serves to hold the hammer bit 119 such that the hammer bit 119 is prevented from slipping off. The hammer bit 119 has an axial groove 119*a* formed in its outer surface. The groove 119*a* is engaged with a plurality of protrusions which are formed on an inner circumferential surface of the bit holding hole 138 and protrude radially inward, so that the hammer bit 119 is prevented from relatively rotating in the circumferential direction with respect to the tool holder 137. Specifically, the hammer bit 119 is held in such a manner as to be prevented from slipping out of the tool holder 137 and prevented from relatively rotating in the circumferential direction with respect to the tool holder 137. Further, the bit holding device 135 is not particularly related to this invention and therefore its specific structure is not described.

In the above-described hammering operation, the hammer bit 119 is acted upon by a reaction (hereinafter referred to as a reaction force) from the workpiece. At this time, the hammer bit 119 is caused to move by the reaction force not only in its axial direction but also in a direction transverse to the axial direction. Specifically, when an external force caused by run-out (irregular motion) of the hammer bit 119 is transmitted to the barrel 106 via the tool holder 137 for holding the hammer bit 119, an entire body 103 including the barrel 106 is caused to vibrate. Further, in the following description, the axial direction of the hammer bit 119 or the fore-and-aft direction is referred to as the direction of the z-axis, the vertical direction perpendicular to the z-axis is referred to as the direction of the y-axis, and the horizontal direction perpendicular to the z-axis or the lateral direction is referred to as the direction of the x-axis, as necessary.

The electric hammer 101 according to this embodiment has first and second vibration-proofing mechanisms 151, 171 in order to reduce or prevent transmission of the external force caused by run-out of the hammer bit 119 to the barrel 106. Firstly, the first vibration-proofing mechanism 151 according to this embodiment is described with reference to FIGS. 2 to 6. The first vibration-proofing mechanism 151 mainly includes a first spherical connection 153, a first coil spring 155, a first slide sleeve 159 and balls 157. The first spherical connection 153 serves to connect the tool holder 137 to the barrel 106 such that the tool holder 137 can rotate about a pivot P (hereinafter referred to as a hypothetical point P) on the axis of the hammer bit (the axis of the barrel 106) or the z-axis. The first coil spring 155 applies a biasing force to the tool holder 137 in such a manner as to normally hold the tool holder 137 in (return it to) its initial position. The first slide sleeve 159 and the balls 157 serve to transmit the biasing force of the first coil spring 155 to the tool holder 137. Further, the initial position herein is a position (as shown in FIGS. 2 and 3) in which the longitudinal axis (center line) of the barrel 106 and the longitudinal axis (center line) of the tool holder 137 lie on (coincide with) the same axis or the z-axis. The first coil spring 155 and the first slide sleeve 159 are features that correspond to the "elastic element" and the "slide member", respectively, according to the invention.

A region of the generally cylindrical tool holder 137 on the side opposite from its front region for holding the hammer bit 119, or a rear region of the tool holder 137 is loosely fitted into a generally cylindrical tool holder receiving part 106*a* formed in a front region of the barrel 106. A concave spherical surface 153*a* (see FIG. 6) centered on the hypothetical point P is formed on a front end surface of the tool holder receiving part 106*a* in its longitudinal direction, and correspondingly, a convex spherical surface 153*b* (see FIG. 6) centered on the hypothetical point P is formed on an outer circumferential surface of the tool holder 137. The concave spherical surface 153*a* and the convex spherical surface 153*b* form a first spherical connection 153. The tool holder 137 is prevented from moving rearward by surface contact between the concave spherical surface 153*a* and the convex spherical surface 153*b*.

As shown in an enlarged view of FIG. 6, in the vicinity of the first spherical connection 153, a plurality of circular ball holding holes 156 are formed in the tool holder receiving part 106*a* at predetermined intervals in the circumferential direction and radially extend therethrough. The balls (steel balls) 157 are fitted in the ball holding holes 156 and allowed to move in a direction transverse to the axial direction of the hammer bit. A groove 137*a* is formed in the outer circumferential surface of the tool holder 137 and continuously extends in the circumferential direction, and the balls 157 are engaged in this groove 137*a*. The balls 157 are biased forward in the axial direction of the hammer bit via the first slide sleeve 159 by the biasing force of the first coil spring 155, so that the balls 157 are pressed against the groove 137*a* of the tool holder 137 from the outside in the radial direction, while being held in contact with a tapered portion 159*a* on the first slide sleeve 159 and with a front wall of the ball holding hole 156.

Further, the first slide sleeve 159 is fitted on the tool holder receiving part 106*a* of the barrel 106 such that it can slide in the axial direction of the hammer bit, and the first coil spring 155 is disposed on the outside of the first slide sleeve 159. One end of the first coil spring 155 is held in contact with a radial engagement end surface 106*b* (a stepped end surface formed between the tool holder receiving part 106*a* and a cylinder receiving part having a larger diameter than the tool holder receiving part 106*a*) formed on the barrel 106. The other end of the first coil spring 155 is held in contact with a rear surface of the tapered portion 159*a* of the first slide sleeve 159 and biases the first slide sleeve 159 forward.

The groove 137*a* of the tool holder 137 has a tapered portion 137*b* on its rear side. The tool holder 137 is prevented from moving forward by contact of the balls 157 with the tapered portion 137*b*. Thus, the tool holder 137 is prevented from moving rearward by the first spherical connection 153 and from moving forward by the balls 157, so that it is prevented from moving in the axial direction of the hammer bit. In this state, the tool holder 137 is coupled to the barrel 106 in such a manner as to be allowed to rotate about the hypothetical point P on the axis of the hammer bit, in the horizontal direction (lateral direction) transverse to the axial direction of the hammer bit or the direction of the x-axis and in the vertical direction or the direction of the y-axis. Further, the tool holder 137 is centered so as to return to its initial position by the biasing force of the first coil spring 155.

Further, lubricant (grease) is sealed in an inner space of the barrel 106. A sealing O-ring 161 is disposed between the outer surface of the tool holder 137 and the inner surface of the tool holder receiving part 106*a* of the barrel 106 in order to prevent lubricant within this inner space from leaking to the outside through a clearance therebetween. Therefore, the O-ring 161 also serves to center the tool holder 137. The O-ring 161 is a feature that corresponds to the "sealing elastic element" according to the invention.

The first vibration-proofing mechanism 151 according to this embodiment is constructed as described above. FIG. 3 shows the state in which a striker 143 is performing a striking movement, or the state in which the striking force of the striker 143 is applied to the hammer bit 119 via the impact volt 145 and the hammer bit 119 is in turn caused to strike the workpiece. FIG. 4 shows the state in which the hammer bit 119 is acted upon by an external force from the workpiece in a direction transverse to its axial direction.

As shown in FIG. 4, when the hammer bit 119 is acted upon by an external force in a direction transverse to its axial direction, the tool holder 137 coupled to the barrel 106 via the first spherical connection 153 rotates about the hypothetical point P together with the hammer bit 119. At this time, some (one or two) of the balls 157 located in the rotating direction (on the upper side as viewed in FIG. 4) are pushed radially outward by the tapered portion 137*b* of the groove 137*a* and in turn push the tapered portion 159*a* of the first slide sleeve 159. Thus, the first slide sleeve 159 is caused to move rearward and elastically deform the first coil spring 155. Specifically, the first coil spring 155 elastically prevents the tool holder 137 from rotating on the hypothetical point P. As a result, the first coil spring 155 absorbs the external force which acts on the hammer bit 119 in the direction transverse to its axial direction, by its elastic deformation, so that the external force is not easily transmitted to the barrel 106. Thus, the external force caused by run-out of the hammer bit 119 is not easily transmitted to the body 103 including the barrel 106, so that vibration of the body 103 is reduced or alleviated.

In this manner, the first vibration-proofing mechanism 151 according to this embodiment is constructed such that the tool holder 137 for holding the hammer bit 119 can rotate about the hypothetical point P on the axis of the hammer bit (the axis of the barrel 106) with respect to the barrel 106, and the tool holder 137 is held in (returned to) the initial position by the biasing force of the first coil spring 155. Particularly, with the construction in which the tool holder 137 rotates via the first spherical connection 153 formed by the concave spherical surface 153*a* and the convex spherical surface 153*b*, the tool holder 137 can smoothly rotate, so that vibration of the barrel 106 caused by run-out of the hammer bit 119 can be effectively reduced.

A second vibration-proofing mechanism 171 is now described. The second vibration-proofing mechanism 171 serves to make it difficult for run-out of the hammer bit 119 to be transmitted to the barrel 106 not only in the direction transverse to the axial direction but also in the axial direction. The second vibration-proofing mechanism 171 is formed by utilizing a cushioning structure 173 which is disposed at the rear of the tool holder 137 and designed to cushion an impact caused during idling. As shown in FIGS. 2 to 5, the second vibration-proofing mechanism 171 mainly includes a second spherical connection 177, a second coil spring 179 for absorbing vibration and a second slide sleeve 178. The second spherical connection 177 connects the impact bolt 145 to the barrel 106 via the cushioning structure 173 such that the impact bolt 145 can rotate about the hypothetical point P on the axis of the hammer bit (the axis of the barrel 106). The second slide sleeve 178 serves to transmit the movement of the impact bolt 145 which is caused by run-out of the hammer bit 119 in the axial direction (the direction of the z-axis) and in the lateral direction (the direction of the x-axis) and vertical direction (the direction of the y-axis) transverse to the axial direction, to the second coil spring 179.

The cushioning structure 173 includes an annular front washer 174 disposed at the rear of the tool holder 137, an annular rubber cushion 175 disposed in contact with a rear surface of the front washer 174 and an annular rear washer 176 disposed in contact with a rear surface of the rubber cushion 175. The rear surface of the rear washer 176 is designed as a convex spherical surface 177*a* centered on the hypothetical point P on the z-axis, and a front surface of the second slide sleeve 178 facing the convex spherical surface 177*a* is designed as a concave spherical surface 177*b* centered on the hypothetical point P. The convex spherical surface 177*a* and the concave spherical surface 177*b* form the second spherical connection 177.

The second coil spring 179 is disposed in a space between a front outer circumferential surface of the cylinder 141 and an inner circumferential surface of the barrel 106. One end of the second coil spring 179 in its longitudinal direction is supported by a rear spring receiving ring 179*a* mounted on the cylinder 141. The other end is held in contact with the rear surface of the second slide sleeve 178 via a front spring receiving ring 179*b*. Thus, the second coil spring 179 applies a forward biasing force to the second slide sleeve 178. Further, the maximum position limit of the front spring receiving ring 179*b* in its forward movement is defined by its contact with a stepped engagement surface 106*c* formed in the barrel 106. Specifically, the biasing force of the second coil spring 179 is not applied to the second slide sleeve 178 over the front maximum position limit which is defined by the engagement surface 106*c*. With such a construction, it is made possible for the second coil spring 179 not to apply the biasing force to the second slide sleeve 178, while the second coil spring 179 is held under a predetermined load in advance. As a result, the tool holder 137 can be prevented from being acted upon by an unnecessary biasing force of the second coil spring 179.

The impact bolt 145 is housed in a rear region of a bore of the tool holder 137 such that it can slide in the longitudinal direction. The rear end portion of the impact bolt 145 protrudes rearward from the bore of the tool holder 137 and this protruding part extends rearward through the front washer 174, the rubber cushion 175, the rear washer 176 and the second slide sleeve 178, and faces a striker 143. Further, the inner circumferential surfaces of the front washer 174 and the rear washer 176 are held in surface contact with the outer circumferential surface of the impact bolt 145. Specifically, the tool holder 137, the impact bolt 145 and the front and rear washers 174, 176 are prevented from moving in the radial direction with respect to each other. Further, the second slide sleeve 178 is prevented from moving in the radial direction with respect to the cylinder 141 and the barrel 106.

The second vibration-proofing mechanism 171 is constructed as described above. Therefore, as shown in FIG. 5, when the hammer bit 119 applies a striking force to the workpiece and then the impact bolt 145 moves rearward together with the hammer bit 119 by a reaction force applied from the workpiece, the cushioning structure 173 held in contact with a rear shoulder portion 145*a* of the impact bolt 145 moves rearward and thereby the second slide sleeve 178 also moves rearward. The second coil spring 179 is elastically deformed by this rearward movement of the second slide sleeve 178. Specifically, the rearward movement of the impact bolt 145 is elastically limited by the second coil spring 179. As a result, the second coil spring 179 absorbs the external force acting on the hammer bit 119 in the axial direction (the direction of the z-axis), so that the external force is not easily transmitted to the barrel 106. In other words, the external force caused by run-out of the hammer bit 119 is not easily transmitted to the body 103 including the barrel 106, so that vibration of the body 103 is reduced or alleviated.

Further, when the hammer bit 119 performs a striking movement on the workpiece, the hammer bit 119 is acted upon by the external force not only in the direction of the z-axis, but also, as described above, in the directions of the x- and y-axes which intersect with the z-axis, which in turn causes the tool holder 137 to rotate about the hypothetical point P. At this time, the impact bolt 145 rotates via the second spherical connection 177 centered on the hypothetical point P. Specifically, the impact bolt 145 rotates together with the tool holder 137 via relative rotation of the second spherical connection 177 which includes the convex spherical surface 177*a* of the rear washer 176 and the concave spherical surface 177*b* of the second slide sleeve 178. Therefore, even if the external force caused by run-out of the hammer bit 119 is exerted on the tool holder 137 and the impact bolt 145 simultaneously in the direction of the z-axis and the directions of the x- and y-axes which intersect with the z-axis, transmission of the external force to the barrel 106 is prevented by the first and second vibration-proofing mechanisms, so that vibration of the barrel 106 can be reduced.

In the electric hammer 101, the instant when pressing of the hammer bit 119 against the workpiece is released in order to finish a hammering operation, the striker 143 strikes the impact bolt 145 at least once at idle. The first vibration-proofing mechanism 151 according to this embodiment exerts an effect of cushioning against such idle striking.

Specifically, when the striker 143 strikes the impact bolt 145 at idle, a forward striking force is applied to the tool holder 137 via the impact bolt 145. At this time, all of the balls 157 are pushed out radially outward by the tapered portion 137*b* of the groove 137*a* of the tool holder 137. As a result, the tapered portion 159*a* of the first slide sleeve 159 is pushed by the balls 157, so that the first slide sleeve 159 is moved rearward and elastically deforms the first coil spring 155. Consequently, the idle striking of the striker 143 is cushioned by the first coil spring 155, so that durability of the members relating to this idle striking can be enhanced.

Further, in this embodiment, with the construction in which the biasing force of the first coil spring 155 is transmitted to the tool holder 137 via the balls 157, transmission of the biasing force can be smoothly realized, and the direction of transmission (direction of movement) can be easily changed, so that the direction of action of the first coil spring 155 can be set to the axial direction of the hammer bit. Thus, the electric hammer 101 can be reduced in size in the radial direction.

Second Embodiment of the Invention

Figure 7:
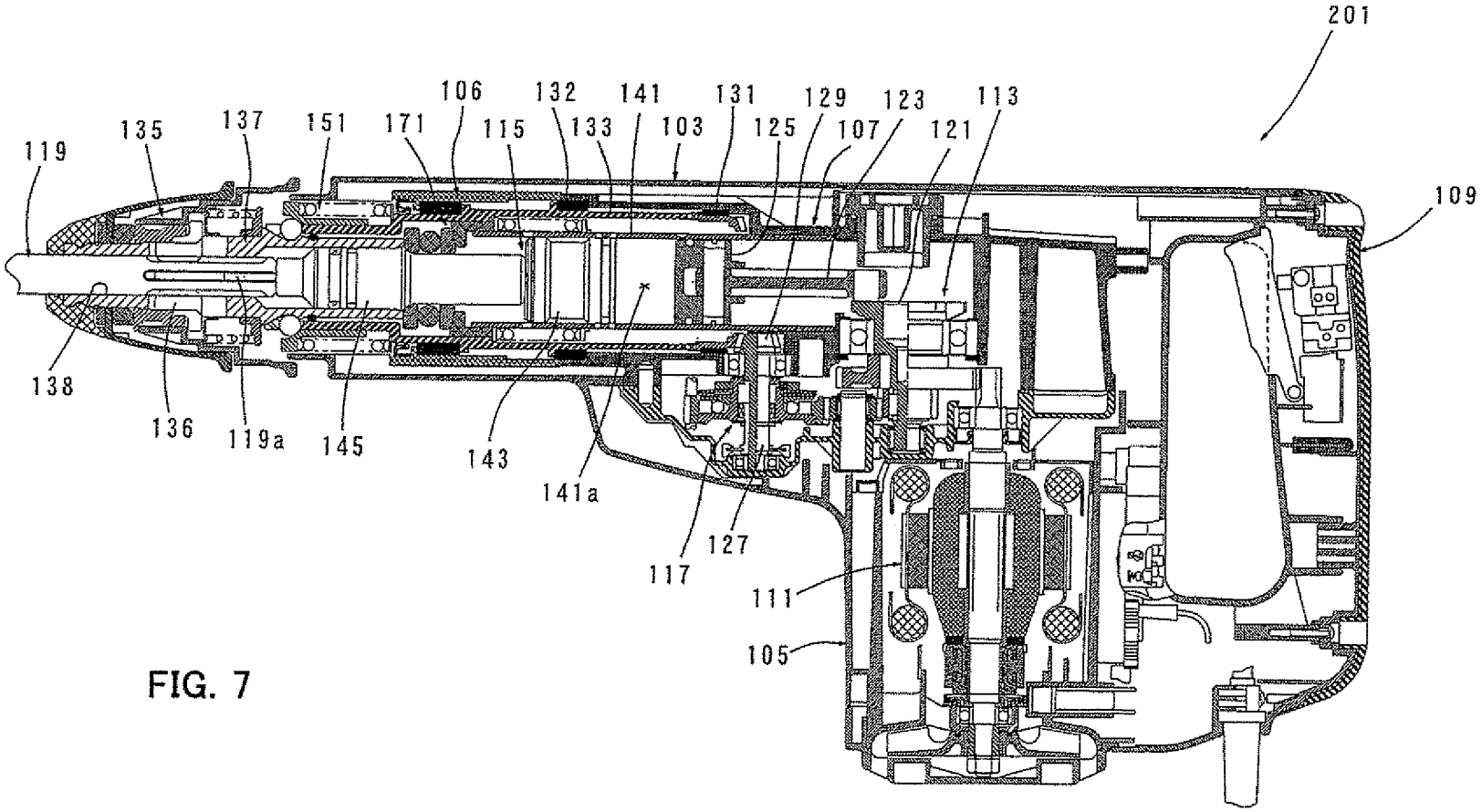
FIG. 7 is a sectional view showing an entire hammer drill according to a second embodiment of this invention.
Figure 8:
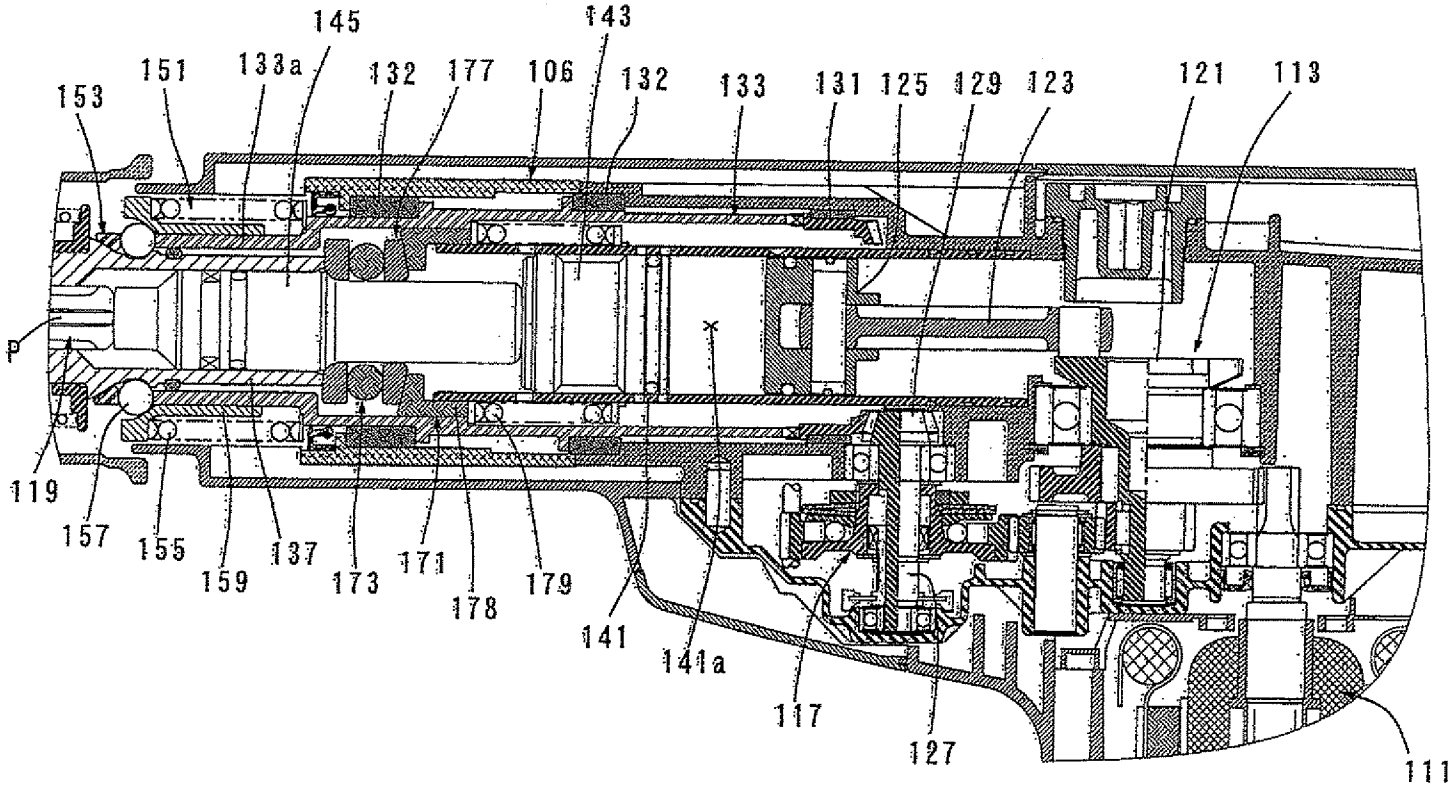
FIG. 8 is a sectional view showing an essential part of the hammer drill.

The second embodiment of the invention is now described with reference to FIGS. 7 to 9. This embodiment is applied to a hammer drill 201 which is a representative example of a power tool of this invention, and described with the emphasis on differences from the above-described first embodiment. Components which are substantially identical to those in the first embodiment are given like numerals as in the first embodiment and are not described or only briefly described.

In the hammer drill 201 according to this embodiment, the tool holder 137 and the hammer bit 119 held by this tool holder 137 are rotationally driven at a reduced speed via the power transmitting mechanism 117 by the driving motor 111. The power transmitting mechanism 117 mainly includes a power transmitting shaft 127 that is driven via a plurality of gears by the driving motor 111, a small bevel gear 129 that rotates together with the power transmitting shaft 127, a large bevel gear 131 that engages with the small bevel gear 129 and rotates about the axis of the hammer bit 119, and a rotating sleeve 133 that rotates about the axis of the hammer bit 119 together with the large bevel gear 131. The rotating sleeve 133 is a feature that corresponds to the "cylindrical rotating member" in claim 7 of the invention. The rotating sleeve 133 is configured as an elongate member disposed in a space between the cylinder 141 and the barrel 106, and rotatably supported in the longitudinal direction via a plurality of bearings 132 by the barrel 106.

The rotating sleeve 133 extends forward such that its front part is fitted onto the rear part of the tool holder 137, and forms a tool holder receiving part 133*a*. The first vibration-proofing mechanism 151 as described in the first embodiment is provided in the tool holder receiving part 133*a* and the rear part of the tool holder 137 which is disposed within the tool holder receiving part 133*a*. Specifically, the tool holder receiving part 106*a* of the barrel 106 in the first embodiment is replaced with the tool holder receiving part 133*a* of the rotating sleeve 133. The first vibration-proofing mechanism 151 mainly includes a first spherical connection 153, a first coil spring 155, a first slide sleeve 159 and balls 157. The first spherical connection 153 serves to connect the tool holder 137 to the rotating sleeve 133 such that the tool holder 137 can rotate about the hypothetical point P on the axis of the hammer bit (the axis of the rotating sleeve 133). The first coil spring 155 applies a biasing force to the tool holder 137 in such a manner as to normally hold the tool holder 137 in (return it to) its initial position. The first slide sleeve 159 and the balls 157 serve to transmit the biasing force of the first coil spring 155 to the tool holder 137.

The first spherical connection 153 includes a concave spherical surface 153*a* centered on the hypothetical point P on the z-axis and a convex spherical surface 153*b* centered on the hypothetical point P. The concave spherical surface 153*a* is formed on a front end surface of the tool holder receiving part 133*a* of the rotating sleeve 133 in its longitudinal direction, and correspondingly, the convex spherical surface 153*b* is formed on the outer circumferential surface of the tool holder 137. Further, the balls (steel balls) 157 are fitted in a plurality of circular ball holding holes 156 which are formed radially through the tool holder receiving part 133*a* of the rotating sleeve 133, such that the balls 157 are allowed to move in a direction transverse to the axial direction of the hammer bit. The first slide sleeve 159 is fitted on the tool holder receiving part 133*a* of the rotating sleeve 133 such that it can slide in the axial direction of the hammer bit 119, and the first coil spring 155 is disposed on the outside of the first slide sleeve 159.

A plurality of recesses 137*c* are formed at predetermined intervals in the circumferential direction in such a manner as to be assigned to the balls 157. Specifically, in this embodiment, one recess 137*c* is provided for each of the balls 157. The recesses 137*c* are engaged with the balls 157 in the circumferential direction, so that the rotating sleeve 133 and the tool holder 137 are prevented from moving in the circumferential direction with respect to each other. In other words, the balls 157 in this embodiment serve not only as a member for transmitting the biasing force of the first coil spring 155 to the tool holder 137, but also as a torque transmitting member for transmitting the rotational force of the rotating sleeve 133 to the tool holder 137.

Figure 9:
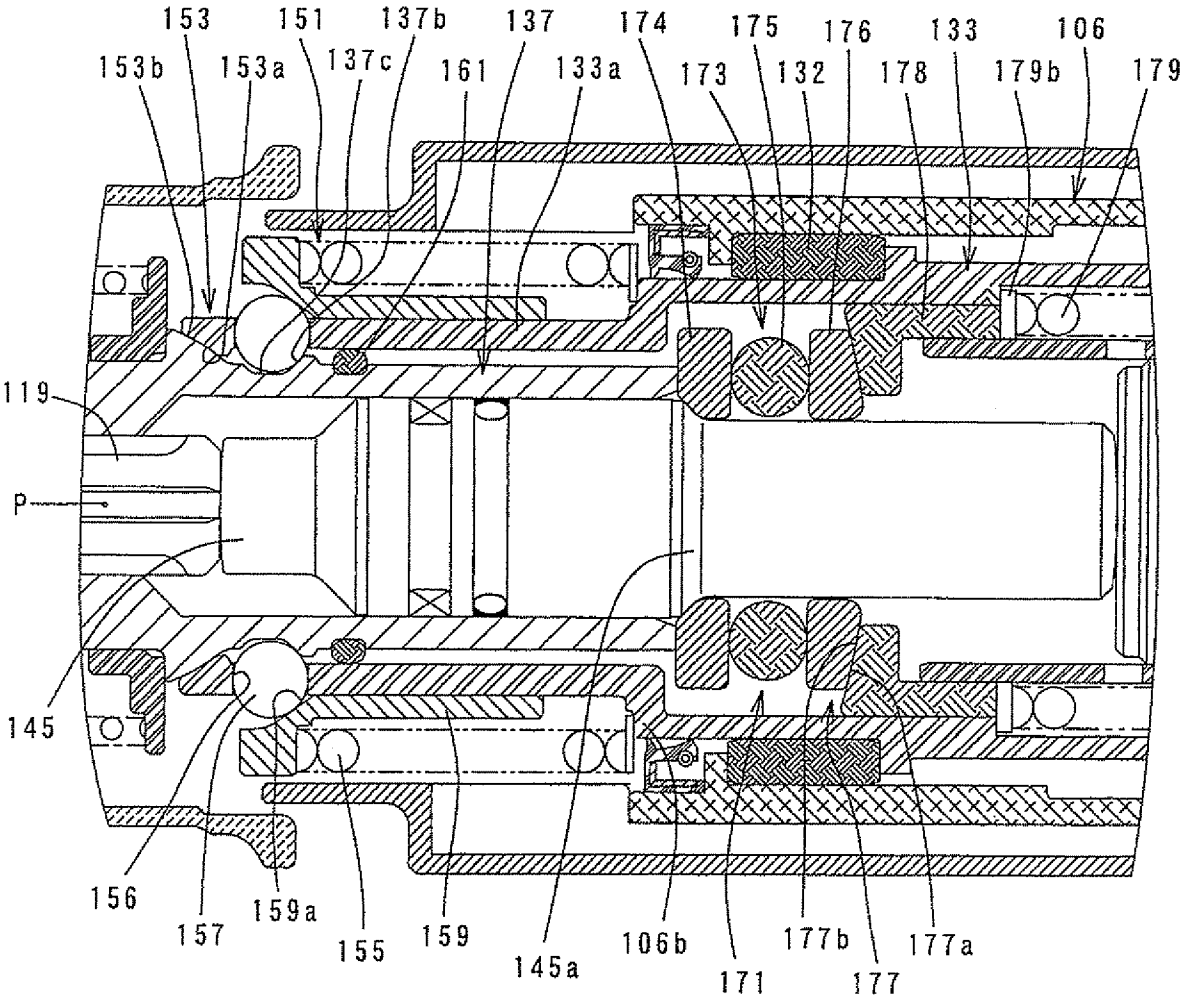
FIG. 9 is a sectional view showing first and second vibration-proofing mechanisms.

Further, as shown in FIG. 9, in the first vibration-proofing mechanism 151, a tapered portion 137*b* is formed on the rear side of the recess 137*c*, and the tool holder 137 is prevented from moving forward by contact of the balls 157 with the tapered portion 137*b*. Further, the tool holder 137 is prevented from moving rearward by the spherical connection 153. These constructions of the first vibration-proofing mechanism 151 are identical to those of the above-described first embodiment.

The second vibration-proofing mechanism 171 is provided such that the second slide sleeve 178 is disposed between the cylinder 141 and the rotating sleeve 133. In the other points, it has the same construction as the above-described first embodiment.

The hammer drill 201 according to this embodiment is constructed as described above. Therefore, when the driving motor 111 is driven under loaded conditions in which the hammer bit 119 is pressed against the workpiece by application of user's forward pressing force to the body 103, a striking force is applied to the hammer bit 119 in its axial direction via the motion converting mechanism 113 and the striking mechanism 115. Further, the power transmitting mechanism 117 is driven by the rotating output of the driving motor 111 and the rotational force of the rotating sleeve 133 in the power transmitting mechanism 117 is transmitted to the tool holder 137 and the hammer bit 119 held by the tool holder 137, via the balls 157. Specifically, the hammer drill performs a hammer drill operation on the workpiece by striking motion in the axial direction and rotation in the circumferential direction of the hammer bit 119.

According to this embodiment, the first vibration-proofing mechanism 151 is provided between the rotating sleeve 133 and the tool holder 137, and the second vibration-proofing mechanism 171 is provided between the rotating sleeve 133 and the impact bolt 145. With such a construction, the external force in the direction of the z-axis or the external force in the directions of the x- and y-axes which intersect with the z-axis, which is caused by run-out of the hammer bit 119 during hammer drill operation, can be prevented from being transmitted to the barrel 106. As a result, vibration of the body 103 can be reduced.

Particularly, in this embodiment, the balls 157 as the components of the first vibration-proofing mechanism 151 serves not only as a member for transmitting the biasing force of the first coil spring 155 to the tool holder 137, but also as a torque transmitting member for transmitting the rotational force of the rotating sleeve 133 to the tool holder 137. Thus, a rational power transmitting structure can be provided.

DESCRIPTION OF NUMERALS

101 electric hammer (power tool)
103 body (tool body)
105 motor housing
106 barrel
106*a* tool holder receiving part
106*b* engagement end surface
106*c* engagement surface
106*d* contact surface
107 gear housing
109 handgrip
111 driving motor
113 motion converting mechanism

115 striking mechanism
117 power transmitting mechanism
119 hammer bit (tool bit)
119*a* groove
121 crank shaft
123 crank arm
125 piston
127 power transmitting shaft
129 small bevel gear
131 large bevel gear
132 bearing
133 rotating sleeve (cylindrical rotating member)
135 bit holding device
137 tool holder
137*a* groove
137*b* tapered portion
137*c* recess
141 cylinder
141*a* air chamber
143 striker
145 impact bolt
145*a* rear shoulder portion
151 first vibration proofing mechanism
153 first spherical connection
153*a* convex spherical surface
153*b* concave spherical surface
155 first coil spring (elastic element)
156 ball holding hole
157 ball
159 first slide sleeve
159*a* tapered portion
161 O-ring
171 second vibration-proofing mechanism
173 cushioning structure
174 front washer
175 rubber cushion
176 rear washer
177 second spherical connection
177*a* convex spherical surface
177*b* concave spherical surface
178 second slide sleeve
179 second coil spring
179*a* rear spring receiving ring
179*b* front spring receiving ring

The invention claimed is:

1. A power tool which performs an operation by linear motion of a tool bit in an axial direction comprising:

a tool body, a tool holder that holds the tool bit in the front end region of the tool holder and extends in the axial direction of the tool bit, an elastic element, a motor, a striking element that is linearly driven in the axial direction of the tool bit by the motor, and an intermediate element that is housed within the tool holder such that it can slide in the axial direction of the tool bit and serves to transmit linear motion of the striking element to the tool bit, wherein a rear region of the tool holder opposite from the front end region extends into the tool body, and in the extending region into the tool body, the tool holder is coupled to the tool body such that the tool holder can rotate about a pivot on a z-axis defined by a longitudinal axis of the tool bit, in directions of y- and x-axes, the y- and x-axes forming a plane perpendicular to the z-axis, wherein the elastic element applies a biasing force to the tool holder in such a manner as to hold the tool holder in an initial position with respect to the tool body, wherein the tool bit is designed as a hammer bit which performs a hammering operation by applying a linear striking force to a workpiece, the power tool further comprising a second elastic element that is disposed between the tool body and the intermediate element and applies a biasing force to the intermediate element in such a manner as to hold the intermediate element in an initial position, and wherein the intermediate element is coupled to the tool body via a second spherical connection which is formed by a convex spherical surface centered on a pivot on the z-axis and a concave spherical surface which conforms to the convex spherical surface.

2. The power tool as defined in claim 1, wherein the tool holder is coupled to the tool body via a spherical connection which is formed by a convex spherical surface centered on a pivot on the z-axis and a concave spherical surface which conforms to the convex spherical surface.

3. The power tool as defined in claim 1, wherein the tool body has a cylindrical tool holder receiving part that receives the extending region of the tool holder extending into the tool body, the power tool further comprising:

a slide member that is disposed on the outside of the tool holder receiving part and can move in the axial direction of the tool bit, a plurality of ball holding holes that are formed in the tool holder receiving part at intervals in a circumferential direction and radially extend through the tool holder receiving part, and balls that are loosely fitted in the ball holding holes and disposed between the slide member and the tool holder, wherein the elastic element is disposed between the tool body and the slide member, and the biasing force of the elastic element is transmitted from the slide member to the tool holder via the balls.

4. The power tool as defined in claim 1, wherein a sealing elastic element is disposed between the tool body and the tool holder and prevents leakage of lubricant sealed in an inner space of the tool body, and the biasing force of the sealing elastic element is applied to the tool holder in such a manner as to hold the tool holder in the initial position.

5. A power tool for performing a hammer drill operation in which a tool bit applies a linear striking force in an axial direction and a rotational force around its axis to a workpiece, comprising:

a tool body, a motor, a tool holder that holds the tool bit in its front end region and extends in the axial direction of the tool bit, an elastic element, a striking element that is linearly driven by the motor and causes the tool bit to perform linear striking motion, an intermediate element that is housed within the tool holder such that it can slide in the axial direction of the tool bit and serves to transmit linear motion of the striking element to the tool bit, and a cylindrical rotating member that is mounted to the tool body such that it can rotate about the axis of the tool bit and rotationally driven by the motor, wherein:

a rear region of the tool holder opposite from the front end region extends into the cylindrical rotating member, and in the extending region into the cylindrical rotating member, the tool holder is coupled to the cylindrical rotating member such that it can rotate about a pivot on a z-axis defined by a longitudinal axis of the tool bit, in directions of y- and x-axes, the y- and x-axes forming a plane perpendicular to the z-axis, while rotating together with the cylindrical rotating member about the axis of the tool bit, wherein the elastic element applies a biasing force to the tool holder in such a manner as to hold the tool holder in an initial position with respect to the tool body, wherein the tool bit is designed as a hammer bit which performs a hammering operation by applying a linear striking force to a workpiece, the power tool further comprising a second elastic element that is disposed between the tool body and the intermediate element and applies a biasing force to the intermediate element in such a manner as to hold the intermediate element in an initial position, and wherein the intermediate element is coupled to the tool body via a second spherical connection which is formed by a convex spherical surface centered on a pivot on the z-axis and a concave spherical surface which conforms to the convex spherical surface.

6. The power tool as defined in claim 5, wherein the cylindrical rotating member has a cylindrical tool holder receiving part which receives the extending region of the tool holder extending into the cylindrical rotating member, the power tool further comprising:

a slide member that is disposed on the outside of the tool holder receiving part and can move in the axial direction of the tool bit, a plurality of ball holding holes that are formed in the tool holder receiving part at intervals in a circumferential direction and radially extend through the tool holder receiving part, and balls that are loosely fitted in the ball holding holes and disposed between the slide member and the tool holder, wherein the balls serve not only as a biasing force transmitting member which transmits the biasing force of the elastic element to the tool holder such that the tool holder is held in the initial position, but also as a torque transmitting member which transmits a rotational force of the cylindrical rotating member to the tool holder.

7. The power tool as defined in claim 2, wherein the tool body has a cylindrical tool holder receiving part that receives the extending region of the tool holder extending into the tool body, the power tool further comprising:

a slide member that is disposed on the outside of the tool holder receiving part and can move in the axial direction of the tool bit, a plurality of ball holding holes that are formed in the tool holder receiving part at intervals in a circumferential direction and radially extend through the tool holder receiving part, and balls that are loosely fitted in the ball holding holes and disposed between the slide member and the tool holder, wherein the elastic element is disposed between the tool body and the slide member, and the biasing force of the elastic element is transmitted from the slide member to the tool holder via the balls.

8. The power tool as defined in claim 2, wherein a sealing elastic element is disposed between the tool body and the tool holder and prevents leakage of lubricant sealed in an inner space of the tool body, and the biasing force of the sealing elastic element is applied to the tool holder in such a manner as to hold the tool holder in the initial position.

9. The power tool as defined in claim 3, wherein a sealing elastic element is disposed between the tool body and the tool holder and prevents leakage of lubricant sealed in an inner space of the tool body, and the biasing force of the sealing elastic element is applied to the tool holder in such a manner as to hold the tool holder in the initial position.

10. The power tool as defined in claim 1, wherein the intermediate element further comprises a protruding part that protrudes rearward from a bore of the tool holder.

11. The power tool as defined in claim 1, wherein the intermediate element further comprises a rear shoulder portion that moves rearward.

12. The power tool as defined in claim 5, wherein the intermediate element further comprises a protruding part that protrudes rearward from a bore of the tool holder.

13. The power tool as defined in claim 5, wherein the intermediate element further comprises a rear shoulder portion that moves rearward.

* * * * *